US006110091A

United States Patent [19]

Morano

[11] Patent Number: 6,110,091

[45] Date of Patent: Aug. 29, 2000

[54] NURSER LINER WITH TEXTURED TABS

[75] Inventor: Emanual P. Morano, Totowa, N.J.

[73] Assignee: Playtex Products, Inc., Westport, Calif.

[21] Appl. No.: 09/280,480

[22] Filed: Mar. 30, 1999

Related U.S. Application Data

[60] Division of application No. 08/579,656, Dec. 27, 1995, which is a continuation-in-part of application No. 08/317,244, Oct. 3, 1994, Pat. No. 5,706,961.

[51] Int. Cl.[7] ..... B65D 30/10

[52] U.S. Cl. ..... 493/223; 493/229; 493/217; 493/922; 83/30; 83/660; 215/11.3

[58] Field of Search ..... 83/30, 660, 691; 225/97, 103; 215/11.3; 72/320, 325; 493/194, 217, 223, 229, 237, 922; 69/2; 222/105; 101/26, 27, 28

[56] References Cited

U.S. PATENT DOCUMENTS

| | | | |
|---|---|---|---|
| 231,109 | 8/1880 | Shirlaw | 83/660 |
| 343,180 | 6/1886 | Leavitt et al. | 83/660 |
| 435,003 | 8/1890 | White et al. | 83/660 |
| 778,006 | 12/1904 | Brooks | 83/660 |
| 2,142,728 | 1/1939 | Kienzle | 83/660 |
| 2,149,913 | 3/1939 | Gilpin | 83/30 |
| 2,711,040 | 6/1955 | Kaplan | 83/30 |
| 3,097,788 | 7/1963 | Nichols . | |
| 3,147,658 | 9/1964 | Boyd | 83/660 |
| 3,547,340 | 12/1970 | McDonald | 383/111 |
| 3,682,028 | 8/1972 | Clayton et al. | 83/30 |
| 3,931,886 | 1/1976 | Yamauchi | 206/390 |
| 4,130,623 | 12/1978 | Walter | 264/293 |
| 5,385,251 | 1/1995 | Dunn | 215/11.3 |
| 5,706,961 | 1/1998 | Morano | 215/11.3 |
| 5,894,947 | 4/1999 | Morano | 215/11.3 |

*Primary Examiner*—M. Rachuba
*Assistant Examiner*—Dominic J. Troiano
*Attorney, Agent, or Firm*—Ohlandt, Greeley, Ruggiero & Perle, L.L.P.

[57] ABSTRACT

There is provided a nurser liner having a pair of removable textured tabs for mounting the nurser liner to the rim of a nurser container. The tabs have a textured surface formed by piercing and embossing with forming tools. Each tab has a plurality of pierced holes that go through the tab to form an improved surface for gripping and handling. Each tab also has a plurality of embossed areas that supplement the pierced holes to improve gripping and handling while minimizing wear to the forming tools. In addition, the tabs may have a three segment pattern such that a smooth, non-textured center portion is located between textured portions on either side of the center portion. Accordingly, the combination of pierced and embossed areas provides the gripping advantages of pierced tabs while minimizing the amount of wear caused to the forming tools.

16 Claims, 5 Drawing Sheets

NURSER LINER WITH TEXTURED TABS

RELATED APPLICATION

This is a division of application Ser. No. 08/579,656, filed Dec. 27, 1995, which is a continuation-in-part of application Ser. No. 08/317,244, filed Oct. 3, 1994 which issued as U.S. Pat. No. 5,706,961.

BACKGROUND OF THE INVENTION

I. Field of the Invention

The present invention relates generally to liners for nurser bottles. More particularly, the present invention relates to tabs located at an open end of a flexible liner, particularly disposable liners, that are designed to facilitate opening the mouth of the liner and mounting of the liner onto a rigid nurser bottle or holder. Furthermore, the particular textured tabs have a tactile feel that improve gripping during opening and mounting of the liner.

Disposable liners for containing liquids have been used with rigid holders to provide a clean, sanitary container for each use instead of reusable bottles which require regular washing and sometimes give questionable results regarding cleanliness. Typically, a liner is mounted onto a holder by gripping the upper edge of the liner, drawing the edge over an open rim of the holder, and folding the edge downward over the outer surface of the holder. The liner is then filled with a desired liquid, and a cover, such as a nursing nipple, may be attached to the holder to close the mouth of the liner.

In order to maintain cleanliness, tabs may be located at the mouth of the liner to provide finger grasp positions. The tabs theoretically permit one to firmly grasp the liner to facilitate opening of the mouth of the liner. The tabs also permit one to draw the liner over the rim of the holder, without one's hands contacting the inside of the liner. The tabs may even be adapted to separate from the liner by the use of perforations once the liner has been mounted on the holder.

It is now appreciated that gripping each tab may be difficult if there is no texturing on the surface of each tab. Moreover, the texturing itself and its placement on the tab's surface will affect the gripability of each tab.

II. Description of the Prior Art

Disposable nurser liners having a graspable flange at the mouth of the liner are known. For example, U.S. Pat. No. 3,204,855 to I. D. Boynton, which issued on Sep. 7, 1965 titled Flexible Container and U.S. Pat. No. 3,790,017 to W. E. Fitzpatrick, et al., which issued on Feb. 5, 1974 titled Nursing Unit, each provide a nurser liner having a pair of hand-graspable tabs at the mouth of the liner to facilitate assembly of the liner in a rigid nurser holder. Each tab has large, smooth surfaces that may be easily grasped between one's thumb and fingers. Thus, the tabs facilitate opening the mouth of the liner and drawing it over the open rim of the holder.

Other examples of nurser products having flexible flanges to facilitate handling and use of the products are provided in U.S. Pat. No. 2,460,329 to A. M. Allen, et al., which issued on Feb. 1, 1949 titled Nursing Unit; U.S. Pat. No. 2,624,485 to F. E. Boston, which issued on Jan. 6, 1953 titled Nurser; U.S. Pat. No. 2,859,891 to G. V. Carkin, which issued on Nov. 11, 1958 titled Nursing Bottle; U.S. Pat. No. 2,881,935 to W. P. Garred, which issued on Apr. 14, 1959 titled Infant's Nursing Bottle Assembly; U.S. Pat. No. 2,939,598 to T. J. Donleavy, which issued on Jun. 7, 1960 titled Dispensing Container; U.S. Pat. No. 3,395,822 to T. J. Donleavy, which issued on Aug. 6, 1968 titled Nursing Device; U.S. Pat. No. 3,645,414 to A. C. Barr, which issued on Feb. 29, 1972 titled Nursing Unit With Improved Plastic Liner; U.S. Pat. No. 3,762,542 to G. S. Grimes, which issued on Oct. 2, 1973 titled Infant Feeding Means; U.S. Pat. No. 3,871,542 to I. M. Hammer, which issued Mar. 18, 1975 titled Disposable Nursing Container; and U.S. Pat. No. 4,711,359 to L. A. White, et al., which issued Dec. 8, 1987 titled Container Such as a Nursing Container, Having Protection Compartment For Dispensing Member.

One problem with the nurser liners of the above patents is that the surfaces of the tabs are smooth and, thus, a firm grasp of the tabs is difficult to attain. In particular, one must hold each tab between his or her thumb and fingers with significant pressure. Accordingly, one or both tabs may slip out from between one's thumb and fingers so that assembly of such nurser liners in a rigid holder is difficult.

In addition to nurser liners, there are also other flexible containers or bags having handles or tabs to facilitate handling and use. Several of these non-nurser products have embossed surfaces to facilitate opening and handling of the product. For example, U.S. Pat. No. 2,197,113 to T. E. Piazze, which issued Apr. 16, 1940 titled Bag Assemblage, provides a bag for packaging merchandise having two walls and a textured zone, located at an upper portion of each wall, that is indented, corrugated, embossed or roughened in order to facilitate the opening or spreading of the upper portions. Also, U.S. Pat. No. 3,224,574 to A. L. McConnell, et al., which issued on Dec. 21, 1965 titled Embossed Plastic Bag, and U.S. Pat. No. 3,411,698 to W. G. Reynolds, which issued Nov. 19, 1968 titled Bag-Like Container Means, each provide embossing the walls of a bag for food products to facilitate the grasping and separating of the bag's walls.

Other examples of non-nurser products having handles or tabs to facilitate handling and use of such products are provided in U.S. Pat. No. 3,148,799 to A. H. Meroney, which issued Sep. 15, 1964 titled Disposable Adjustable Receptacle Liner For Wet Refuse; U.S. Pat. No. 3,166,220 to S. W. Rabb, et al., which issued on Jan. 19, 1965 titled Dispensing Holder and Receptacle; U.S. Pat. No. 3,170,619 to J. P. Repko, which issued on Feb. 23, 1965 titled Tear Strip Packaging; U.S. Pat. No. 3,393,861 to W. J. Clayton, et al., which issued Jul. 23, 1968 titled Embossed Thermoplastic Bags; U.S. Pat. No. 3,441,198 to A. E. Ericson, which issued Apr. 29, 1969 titled Flexible Bag For Packaging Food Items; U.S. Pat. No. 3,534,901 to J. P. Repko, et al., which issued on Oct. 20, 1970 titled Bag Construction; U.S. Pat. No. 3,550,839 to W. J. Clayton, which issued Dec. 29, 1970 titled Doubled Walled Plastic Bag; U.S. Pat. No. 3,873,735 to M. L. Chalin et al., which issued on Mar. 25, 1975 titled Food Package For Heating and Venting; U.S. Pat. No. 4,509,570 to J. Eby, et al., which issued Apr. 9, 1985 titled Elastic Top Bag; U.S. Pat. No. 4,524,457 to F. J. Marino, which issued on Jun. 18, 1985 titled Cargo Bag With Reinforced Triangular Lifting Panels; U.S. Pat. No. 4,747,701 to S. Perkins, which issued May 31, 1988 titled Plastic Liner Bag With Elastic Top and Method of Making; U.S. Pat. No. 4,549,657 to A M. Martin, which issued on Oct. 29, 1985 titled Easily Opened and Reclosable Bag and Apparatus For Making Same; U.S. Pat. No. 4,759,639 to R. B. DeMatteis, which issued on Jul. 26, 1988 titled Thermoplastic Bag; and U.S. Pat. No. 4,769,126 to R. M. Roen, et al., which issued Sep. 6, 1988 titled Bottom Gusset Bag Pad Arrangement For Liquid Containers.

Since these containers and bags are not nurser liners, they are not suited for mounting on nurser bottles. Although several of these containers and bags have embossed surfaces, such embossed surfaces do not provide adequate gripping surfaces for nurser liners. In particular, the above patents do not describe or suggest gripable tabs that permit one to draw them over an open rim of a rigid holder and fold them downward over the outer surface of the holder. This operation of assembling the nurser liner in a rigid holder requires a significantly tight grip to prevent the tabs from slipping out of one's hands and to facilitate assembly in the holder.

A disposable nurser liner having a gripable embossed tabs at the mouth of the liner is shown in U.S. Pat. No. 5,385,251 to S. B. Dunn, which issued on Jan. 31, 1995, titled Disposable Bottle Bags For Use With Infant Nursing System. This patent provides a nurser liner having integrally embossed surfaces adjacent to the mouth of the liner to facilitate the separation of adjacent surfaces at the liner's mouth. This patent also provides another embodiment having a half-circular finger hole in the middle of each tab and a further embodiment having a combination of the embossed surfaces and the half-circular finger hole. However, these embossed tabs have poor gripping surfaces. Also, the half-circular finger hole significantly reduces the surface area of the tabs and, thus, provide less surface area for one to grip. Further, the nurser product distributed by the assignee of U.S. Pat. No. 5,385,251, namely Munchkin Bottling Inc. of Van Nuys, Calif., has the combination of the embossed surfaces and the half-circular finger hole. Therefore, it appears that the embossed surfaces require the finger holes to provide an adequate grip. Also, the combination of these two features obviously makes manufacturing more time consuming and, therefore, costly.

Another problem with the nurser liner of the above patent is that embossing the tabs and/or the addition of finger holes hinders one's capability to open the mouth of the liner. For example, the liner's mouth may be opened by gripping the middle portion of each tab between one's finger and thumb and sliding them past one another. This process distorts the mouth of the liner and separates the tabs so that each tab may be gripped by each hand of a person. By embossing the tabs, the friction between the adjacent surfaces of each tab increases so that it is more difficult to slide the tabs past one another. Also, the creation of finger holes in the tabs reduces available surface area and, particularly, the most convenient surface of the tabs to grip, i.e., the middle portion. Thus, a finger hole further hinders opening of the liner mouth.

A gripable surface that provides a sufficient grip to prevent the tabs from slipping out of one's hands and to facilitate assembly in the holder is provided in co-pending parent application Ser. No. 08/317,244 cited above, which application is owned by the assignee of the present invention. Specifically, each tab of the nurser liner has a plurality of ruptured areas formed by completely piercing through the tab all of the time. By piercing, the completely pierced through or ruptured areas form a tactile surface to facilitate gripping of each tab. Also, each tab has the pierced through surface on the same side so that the mating surfaces of the pair of tabs have different features to facilitate separation. Accordingly, the pierced tabs of the above co-pending parent application provide a tactile surface that is better and easier to grip than embossed surfaces or finger holes. Moreover, it is easier to separate the adjacent tab surfaces.

However, it has been determined that the piercing tools used to pierce through the tabs one hundred percent of the time become dull relatively quickly. Thus, the manufacturing cost of the nurser liners having one hundred percent piercing increases due to the cost of replacing worn or dull piercing tools. In particular, the replacement cost includes the actual cost of the tools, the labor cost of replacing the tools, and the production time lost until replacement. Therefore, the present invention provides a nurser liner having the gripping advantages of pierced tabs, as described in the above co-pending parent application, while extending the service life of the piercing tools.

SUMMARY OF THE INVENTION

Against the foregoing background, it is a primary object of the present invention to provide a flexible liner having a pair of tabs with each tab having a textured surface to improve gripping during opening and mounting of the liner.

It is another object of the present invention to provide such a flexible liner in which each tab has a textured surface formed by a combination of piercings through the tab and embossments on one surface of the tab.

It is a further object of the present invention to provide such a flexible liner in which each tab has a unique pattern on the textured surface that is formed by piercing and embossments.

It is still further object of the present invention to provide such a flexible liner in which the middle portion of the textured surface of each tab is smooth to provide minimal friction for easy separation of the pair of tabs.

It is yet another object of the present invention to provide such a flexible liner with a pair of each tabs having a surface with a particular pattern of piercings and embossments surfaces in which the adjacent surfaces of the tabs initially conform to each other but, after separation of the tabs, the adjacent tab surfaces breakaway and do not easily conform or match-up to each other and, thus, provide easy separation of the tabs.

To accomplish the foregoing objects and advantages, the present invention, in brief summary, is a textured tab of a flexible liner for a rigid holder which comprises a textured surface having a plurality of ruptured areas formed by piercing through the tab and a plurality of non-ruptured areas formed by embossing the tab such that the plurality of ruptured areas and the plurality of non-ruptured areas form a tactile surface to facilitate gripping of the tab.

In addition, the present invention is a flexible liner for mounting on a rigid holder in which the liner has a tubular shape that is normally flattened for transport and handling. The liner comprises a closed bottom, an open top located opposite the bottom, and at least one tab. The tab comprises a first side having a virtually smooth surface, and a second side opposite the first side. The second side has a plurality of ruptured areas formed by piercing the tab from the first side through the second side and a plurality of non-ruptured areas formed by embossing the tab on the first side to form a protrusion on the second side such that the plurality of ruptured areas and the plurality of non-ruptured areas form a tactile feel on the second side surface to facilitate gripping.

More specifically, the flexible liner comprises a liner body and at least a pair of tabs removably secured to the liner body. Each tab has a plurality of ruptured areas formed by piercing through the tab and a plurality of non-ruptured areas formed by embossing the tab in which the plurality of ruptured areas and the plurality of non-ruptured areas for each tab forms a tactile first surface to facilitate gripping of the tab, and the first surfaces of the tabs are not opposite or facing each other.

In an alternative embodiment, the tab comprises a plurality of first ruptured areas formed by piercing the tab from the second side through the first side opposite the second side. The second side has a plurality of second ruptured areas formed by piercing the tab from the first side through the second side. Also, each of the first side and the second side ruptured areas have a plurality of non-ruptured areas formed by embossing the tab. Thus, the plurality of ruptured areas and the plurality of non-ruptured areas form a tactile surface to facilitate gripping of the tab.

In addition, the present invention is a method for forming a tactile surface on a pair of tabs of a formed flexible liner. First, a first tool is positioned so that a plurality of teeth of the first tool is directed toward a receiving surface of a second tool. The tabs of the flexible liner are then situated between the plurality of teeth and the receiving surface. At least one or both first and second tools are then moved towards the other tool. A particular percentage of the plurality of teeth is pierced through a desired portion of the pair of tabs with sufficient force so that the teeth just contacts the receiving surface, thereby forming a plurality of pierced holes through the pair of tabs. Thereafter, the plurality of teeth are drawn away from the receiving surface, leaving a tactile surface on one side of each pair of tabs and a non-tactile surface on the opposite side of each pair of tabs.

BRIEF DESCRIPTION OF THE DRAWINGS

The foregoing and still further objects and advantages of the present invention will be more apparent from the following detailed explanation of the preferred embodiments of the invention in connection with the accompanying drawings.

DETAILED DESCRIPTION OF THE PREFERRED EMBODIMENTS

The present invention is directed to tabs located at an open end of a flexible liner that facilitate opening the mouth of the liner and mounting of the liner onto a rigid nurser bottle or holder. In particular, the tabs have textured portions that are formed by piercing and embossing. The pierced areas provide a tactile feel that improve gripping during opening and mounting of the liner, and the embossed areas supplement the pierced areas to provide further support for gripping. Preferably, the pierced areas and the embossed areas are evenly spaced from each other throughout each textured portion. At least about 50% of the textured portion is pierced with the remainder of the textured portion being embossed.

The present invention provides an easier and more economical process for forming pierced tabs. In particular, the life of the tool used to form the pierced areas is extended, and the cost of maintaining such tool is reduced. Although a textured surface having pierced areas would provide a good gripping surface, substitution of some pierced areas with embossed areas, as described above, may provide an even better gripping surface due to the different textures of the embossments and pierced through surfaces.

Moreover, while providing such satisfactory gripping surface, the present invention gives the same tool extended life. For example, when forming a plurality of liner-having textured tabs, a new tool would form tabs in which all impressions would be pierced areas. After producing a certain number of liners, the tool would gradually become dull and, thus, produce embossed areas instead of pierced areas. If all impressions must be pierced areas, then the manufacturing process must be replaced. The present invention permits embossed areas so that the manufacturing process may continue using the same tool until a particular minimum percentage of pierce areas is reached. As stated above, it is preferred that each tab have at least 50% piercings of the textured portions.

Figure 1:
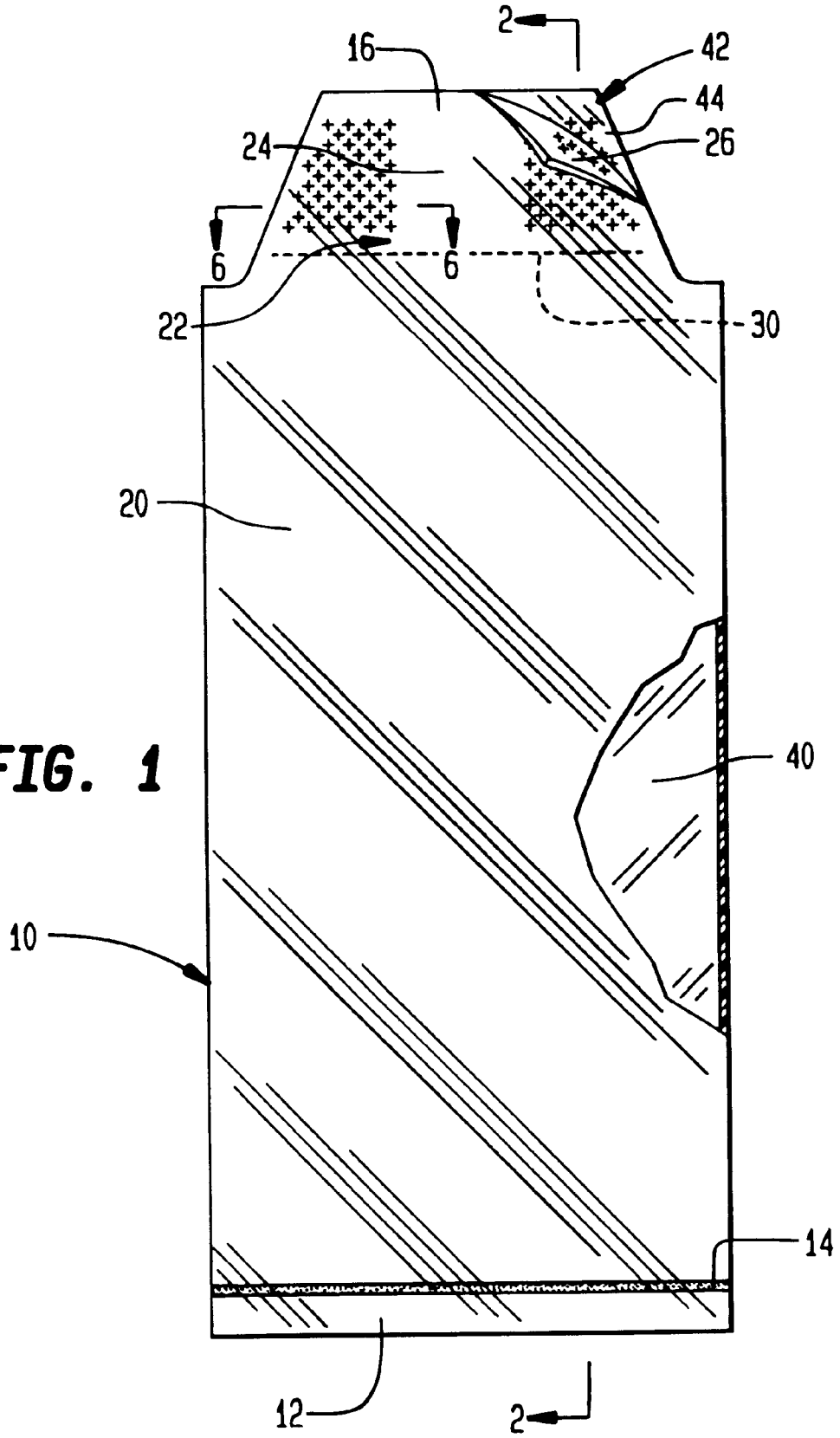
FIG. 1 is a planar view of a flexible liner of the present invention.

Referring to the drawings and, in particular, to FIG. 1, there is provided a flexible liner of the preferred embodiment which is generally represented by reference numeral 10. The liner 10, preferably, has a tubular shape that can be collapsed or flattened so that it may be packaged in roll form for transport and handing. -The liner 10 has a bottom end 12 that is heat sealed along a strip 14. Strip 14 is, preferably, offset from the bottom edge of the liner 10. In the flattened state, shown in FIG. 1, each liner has two sides, namely a first side 20 having a tab 22, and a second side 40 having a tab 42.

Figure 2:
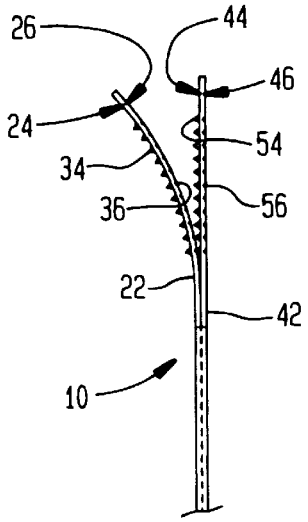
FIG. 2 is a sectional view along line 2—2 of FIG. 1, in which one tab is curved away from the other tab.

Referring to FIGS. 1 and 2, each tab 22, 42 is located at a top end 16 of the liner 10 and, preferably, has a trapezoidal shape such that the left side of the tab is substantially symmetrical to the right side of the tab. Each tab 22, 42 has a first, textured surface 24, 44 and a second, non-textured surface 26, 46 opposite the first surface. Also in the preferred embodiment, a tab perforation 30 is provided at the base of each tab 22, 42 to facilitate removal of the tabs after the liner 10 has been assembled in a rigid holder.

In the preferred embodiment, the first surfaces 24, 44 of tabs 22, 42 are textured and have a tactile feel, whereas the second surfaces 26, 46 have a non-tactile feel. The textured surface 44 is positioned adjacent a non-textured surface 26 when the liner 10 is in its collapsed or flattened form.

Referring to FIG. 2, tabs 22, 42 have a plurality of protuberances 34, 54 on their first, textured surfaces 24, 44 and plurality of penetrated depressions 36, 56 on their second, non-textured surfaces 26, 46. The protuberances 54 of one tab 42 correspondingly mate with the depressions 36 on the other tab 22 when the liner 10 is in its collapsed or flattened form. As shown in FIG. 2, the texture of the first surfaces 24, 44 remain even when the tabs 22, 42 are separated from each other.

Figure 3:
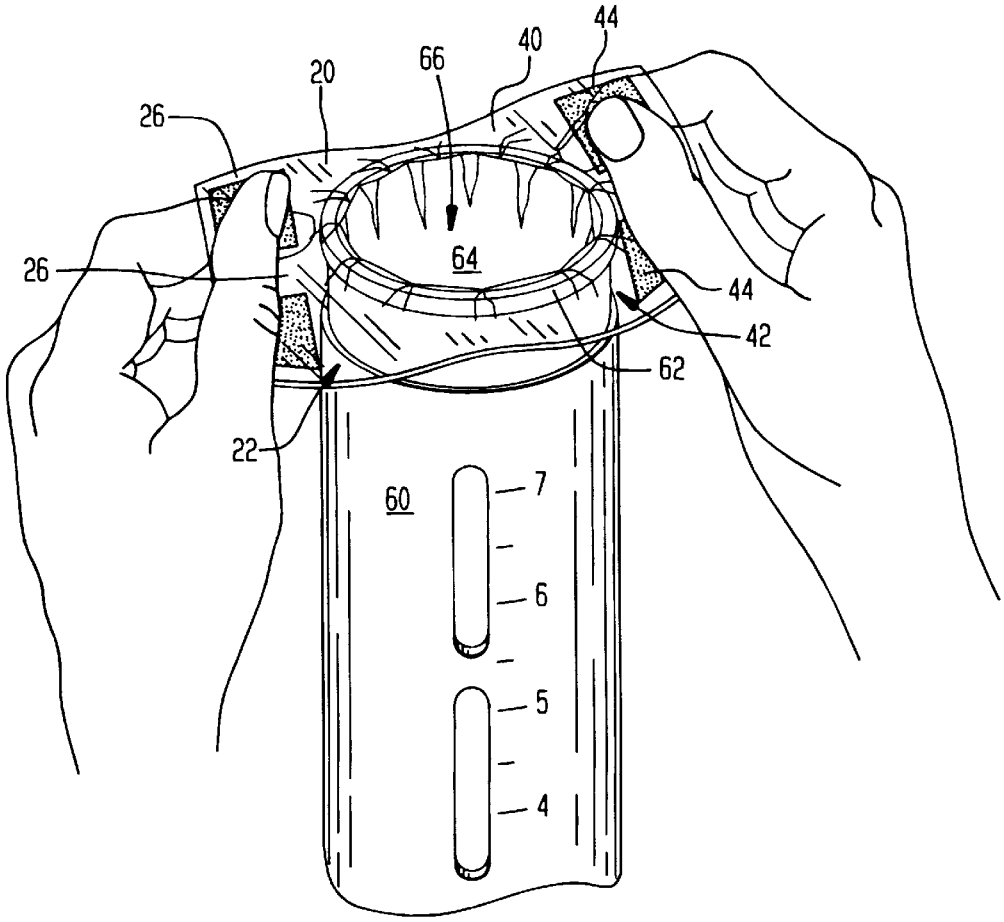
FIG. 3 is a perspective view of the liner of FIG. 1, in which the flexible liner is positioned and assembled partially in a rigid holder.

Referring to FIG. 3, the operation of mounting the liner 10 of the preferred embodiment to a rim 62 of a rigid holder 60 is shown. First, the liner 10 is inserted down into the interior 64 of the holder 60 through an open end 66. Tab 22 of the liner 10 is grasped by a thumb and finger of one hand while tab 42 is, likewise, grasped by the other hand. Next, the two tabs 22, 42 are drawn apart and pulled down over the rim 62 at the open end 66. A force that is strong enough to stretch the liner 10 beyond the dormant form of the holder 60 is required. Accordingly, the tabs 22, 42 must provide the best possible grip in order to facilitate this attachment process. The liner 10 is drawn downward over the outer periphery of the rim 62 of the holder 60 until the lower portion of the liner 10 is secured to the holder, just below the tab perforation 30. In the preferred embodiment, the tabs 22, 42 are then pulled and, thus, removed from the liner 10.

Figure 4:
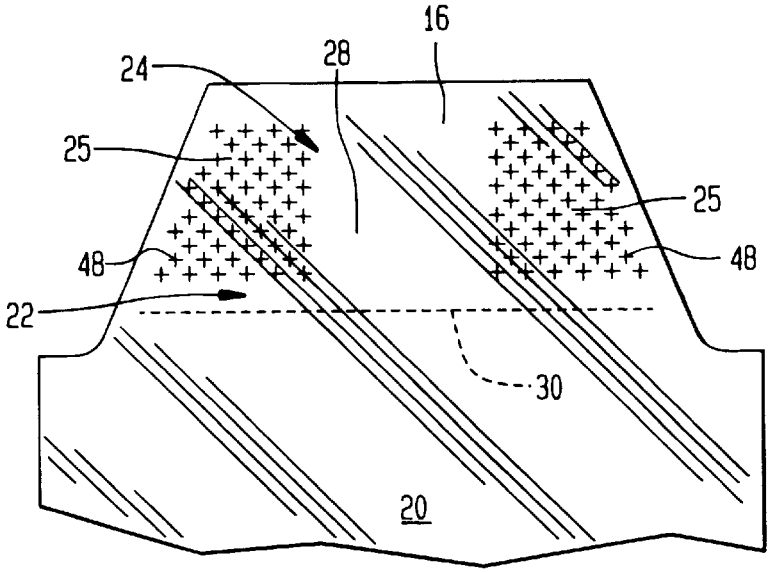
FIG. 4 is an enlarged view of a tab of the liner of FIG. 1, illustrating a liner having a plurality of pierced holes.
Figure 5:
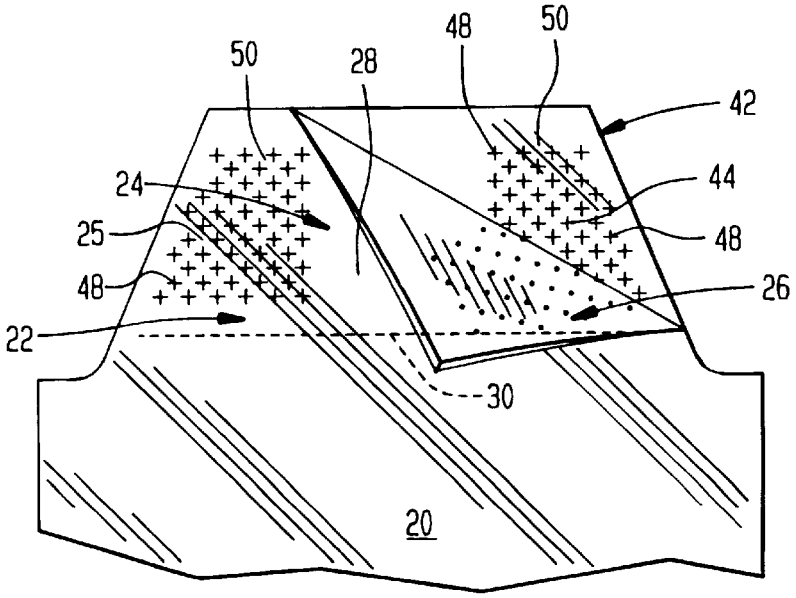
FIG. 5 is an enlarged view of the tab of the liner of FIG. 1, illustrating a liner having a plurality of pierced holes and embossed areas.

FIGS. 4 and 5 are enlarged views of the tab 22 of FIG. 1 that illustrate, by example, two embodiments of the textured surface having pierced and embossed areas. Specifically, a first embodiment is shown in FIG. 4, and a second embodiment is shown in FIG. 5. Both tabs 22, 42 have a textured or tactile surface 24, 44 and a smooth or non-tactile surface 26, 46 (in which surface 46 is shown in FIG. 2). Each surface 24, 26, 44 & 46 is dimensionally large enough to accommodate a human finger or thumb for gripping.

The tabs 22 of FIGS. 4 and 5 have different ratios of ruptured or pierced areas 48 versus non-ruptured or embossed areas 50. Referring to the first embodiment of FIG. 4, the tactile surface 24 of the tab 22 has a plurality of ruptured areas 48 formed by piercing through the tab 22 but does not have any non-ruptured areas 50 formed by embossing the tab. Thus, the first embodiment has 100% ruptured areas 48 formed by piercing through the tab 22. In contrast, referring to the second embodiment of FIG. 5, the tactile surface 24 of the tab 22 has a combination of ruptured areas 48 formed by piercing and non-ruptured areas 50 formed by embossing. In reference to FIG. 5, the non-ruptured areas 50 are indicated as open areas in the textured surface between ruptured areas 48. The ruptured areas 48 provide a solid, prominent gripping surface, and the non-ruptured areas 50 supplement the gripping property of the ruptured areas. Although the first embodiment of FIG. 4 provides a stronger grip than that second embodiment of FIG. 5, the second embodiment provides an effective grip for mounting the nurser liner 10 in the holder that is much better than grips provided by embossed surfaces alone. Preferably, each textured or tactile surface 24, 44 has at least 50% ruptured areas 48 formed by piercing through the tab 22.

As shown in FIGS. 4 and 5, each tactile surface 24, 44 has a pair of textured portions or sections 25 separated by a smooth portion or section 28. The smooth portion 28 is provided in order to facilitate the separation of tabs 22, 42. Initially, the tactile surface 44 of tab 42 is attached to the non-tactile surface 26 of tab 22 due to the pierce-through manufacturing technique of forming the surfaces. Specifically, the pierced portion 25 of tactile surface 44 of tab 42 is mated to non-tactile surface 26 of tab 22. In order to release and separate the tactile surface 44 of tab 42 from tab 22, a thumb is, preferably, placed on the smooth portion 28 and a finger is placed on the non-tactile surface 26 of the tab, thereby grasping the two sides or surfaces of the tab between the thumb and finger. By sliding one surface against the other, preferably by shifting the positions of the thumb and finger, the tactile surface 44 of tab 42 separates from the non-tactile surface 26 of tab 22 as shown in FIG. 3.

Once the tactile surface 44 of tab 42 and the non-tactile surface 26 of tab 22 are shifted and detached from each other, the top end 16 of the liner 10 becomes very easy to open. In fact, the separation of the tabs 42, 22 is much more distinct for the present invention than that of purely embossed tabs or purely pierced tabs. For purely embossed tabs or purely pierced tabs, each impressed surface is similar in shape. An embossed or pierced area at one position may shift over a similar embossed or pierced area at an adjacent position. Thus, the tactile surface 44 of tab 42 would still be in a substantially close or mated position with the non-tactile surface 26 of tab 22. In contrast, for the present invention, the textured portions 25 of the tabs 42, 22 include a combination of pierced areas 48 and embossed areas 50. Therefore, when the tabs 42, 22 are shifted for opening the liner 10, many of the pierced areas 48 of the tactile surface 44 of tab 42 will shift to embossed areas 50 of the non-tactile surface 26 of tab 22 and vice versa. Accordingly, a more distinct separation of the tabs 42, 22 is formed for the present invention.

The tabs 22, 42 are provided in order to facilitate the application of the top end 16 of the liner 10 onto the open end 66 of the holder 60. As explained above, the tab 22 of the liner 10 is pulled out and over the rim 62 of the open end 66 by simultaneously grasping the tabs 22, 42. The tactile surfaces 24, 44 of the tabs 22, 42 permit a human finger to better grip those surfaces tightly in order to complete the mounting operation. The rougher, higher friction surface or more tactile surface provided by the present liner is desirable since such a surface would enhance the ability of a finger to hold onto the tab.

It has been found that the manufacturing technique of the present invention that combines pierce-through and embossment techniques provides a rougher, higher friction surface than the simple embossment techniques described in the prior art. Thus, the technique for producing the high friction characteristic of the tabs 22, 42 of the present invention is to pierce through the entire thickness of each tab in at least a portion of each tab 22, 42.

Figure 6:
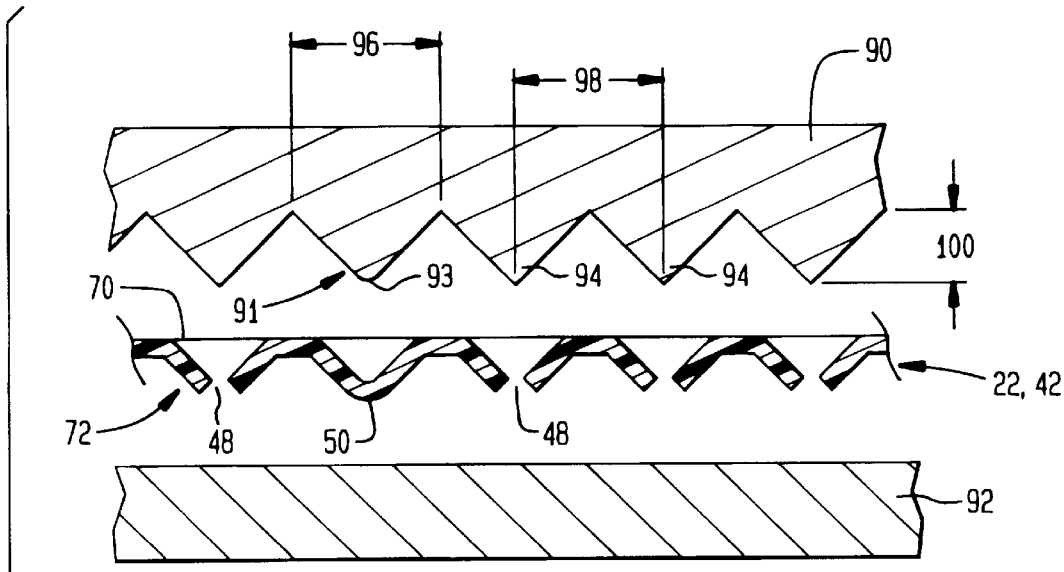
FIG. 6 is a sectional view of a row of holes of the tab taken along line 6—6 of FIG. 1.

Referring to FIGS. 6, the preferred method for making each tab 22, 42 is shown. The tabs 22, 42 are positioned between an upper tool 90 and a lower tool 92. In the preferred embodiment, the upper tool 90 has a piercing edge 91. The upper tool 90 is moved downward to just touch against lower tool 92 and, thus, the piercing edge 91 pierces a portion of tabs 22, 24. The tools 90, 92 can also be pressed together by either or both moving towards each other. Also, either tool can have a piercing edge 91. The piercing edge 91 can be any conventional cutting tool having a plurality of piercing or toothed elements. However, the piercing edge 91 needs to be hardened to a minimum value of approximately 40 to 45 $R_c$ using an appropriate hard substance, such as steel, to help maintain a uniform pattern with consistent piercing capability. The lower tool 92 is made of a softer material than that of the upper tool 90 but should be hard enough to control the size of the opening formed in the pierced area 48.

For the preferred embodiment, the upper tool 90 is formed of hardened steel, and the lower tool 92 is an anvil formed of a softer steel. To form liners having tabs with 100% ruptured areas, the upper tool would last about 6 weeks. In contrast, to form liners having tabs with 50% ruptured areas, the upper tool would last about 16 weeks. Thus, the life of the upper tool for the present invention is more than 2½ times longer than the life of a tool for forming 100% ruptured areas.

In the preferred embodiment shown in FIG. 6, only one piercing edge 91 is needed and desired. Specifically, the upper tool 90 has the piercing edge 91, whereas as the lower tool 92 is simply a base planar surface. In contrast, embossing requires that both upper and lower tools be carefully structured and aligned to mesh perfectly with each other. Furthermore, embossing causes a strong bond between the two tabs that is more difficult to overcome when the tabs are to be separated.

To form the tactile surface 24, the piercing edge 91 enters the non-tactile surface 26 and pierces through certain portions of the tab 22, 42 and out the tactile surface 24, 44 to just touch the lower tool 92. Too much pressure will cause the piercing edge 91 to press against the lower tool 92 causing the piercing edge 91 to dull quickly and, thus, should be avoided. In addition, certain duller portions 93 of the piercing edge 91 form non-ruptured or embossed areas 50 of the tactile surface 24. Thus, the tactile feel on tactile surface 24, 44 is due to the tips of the pierced holes or areas 48 and the embossed areas 50.

The piercing edge 91 of the upper tool 90 has a plurality of teeth 94. Each tooth 94 has a width 96 between about 0.015 inches and about 0.250 inches, and the teeth 94 are located at intervals 98 between about 0.015 inches and about 0.250 inches from each other. The height 100, as measured from the base to the tip of each tooth 94, ranges from about 0.005 inches to about 0.125 inches. Of course, after extensive use and for forming embossed areas 50, the tip of the tooth is worn down and the height 100 is reduced. For the preferred embodiment, the dimensions about the teeth 94 include a width 96 about 0.040 inches, a location at intervals 98 about 0.040 inches and a height 100 of 0.020 inches, i.e., of microscopic proportions.

Figure 7:
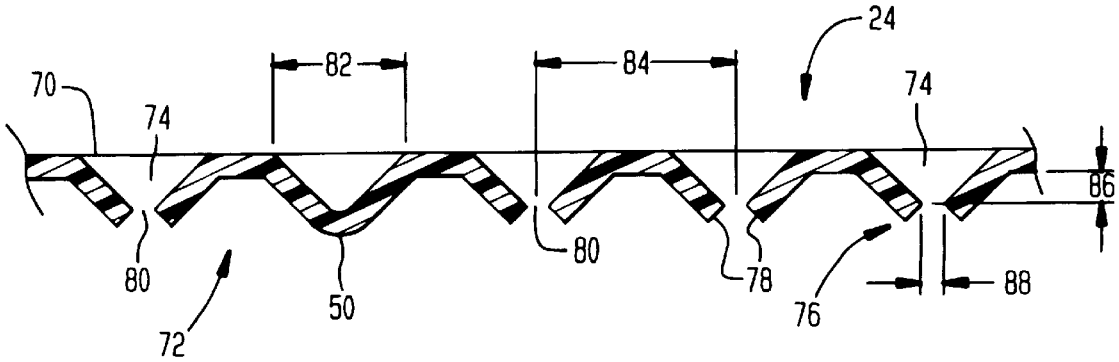
FIG. 7 is a schematic illustrating the formation of the row of holes of FIG. 6.

As shown in FIG. 7, the smooth surface 70 of tile textured surface 24 is substantially planar and has occasional gaps 74 therein. The rough surface 72 of the textured surface 24 has ruptured areas 48 that are raised and tactile due to the rough edges 78 of the ruptured areas around pierced holes 80. Each ruptured area 48 has a substantially rectangular base formed at the smooth surface 70. The gaps 74 contract to form a virtually smooth or non-textured surface once the piercing edge 91 is removed from the tabs 22, 42. Significantly, other textured products described in the prior art have solely embossed surfaces that feel smooth, and not tactile, because they do not provide the roughened tactile surface formed by the pierce through tabs of the present invention.

For the preferred piercing edge 91, the dimensions of the ruptured areas 48 of the tactile surfaces 24, 44 are as follows: the width 82 of each ruptured area 48 is between about 0.005 inches and about 0.100 inches, and the interval 84 at which the ruptured areas are situated from each other is between about 0.015 inches and about 0.250 inches. Also, the height 86 as measured from the rough surface 72 to each pierced area 48 ranges from about 0.001 inches to about 0.050 inches. Each individual hole 80 is no larger than about 0.030 inches in diameter 88. The recommended dimensions of the ruptured areas 48 are a width 82 about 0.028 inches, intervals 84 about 0.040 inches, height 86 about 0.003 inches and hole size 88 that is about 0.005 inches in diameter, i.e., of microscopic proportions. It is believed that the above recommended width 82 and interval 84 may vary by about ±0.005 inches, and the height 86 and hole size 88 may vary by about ±0.002 inches.

To determine consumer response to the textured tabs of the present invention, a test was conducted between a liner of the present invention having tabs with 50% pierced or ruptured areas and an existing liner having tabs that do not have pierced or ruptured areas. In particular, the existing liner tested is the nurser product distributed by the assignee of U.S. Pat. No. 5,385,251, which has an embossed surface with a half-circular finger hole in the middle of the embossed surface. Each panelist was a current disposable bottle user at the time of testing who had at least one infant that was 12 months old or younger.

The panelists were provided with a sample box of each product and asked to dispense and apply one of each liner to a rigid holder. The first liner for the panelists was alternated to avoid first-use bias. Each panelist was then asked for their preference for ease of opening, preference for application to the holder, and why to both preferences. The results of the test showed that the 50% ruptured area tabs of the present invention were strongly preferred over the purely embossed tabs of the other product for both ease of opening and ease of application. The reasons for preferring the present invention for ease of opening included a thicker feel, more friction for ease of use, ease of handling due to texture, resistance to tearing or ripping, and resistance to sticking together. The reasons for preferring the present invention for ease of application onto the holder included ease of pulling over the rim, better fit, and thicker feel that was not too flimsy.

A comparison test between a liner having tabs with 50% ruptured areas and a liner having tabs with 100% ruptured areas was also conducted. As with the test described above, each panelist was a current disposable bottle user at the time of testing who had at least one infant that was 12 months old or younger. The test product was an 80 count box of disposable liners having textured tabs with 50% pierced areas, and the control product was an 80 count box of disposable liners having textured tabs with 100% pierced areas.

Of the 101 panelists tested, 33% preferred the test product of the present invention, 30% preferred the control product having textured tabs with 100% pierced areas and 38% had no preference. In fact, 91% of the panelists queried stated that they would purchase the test product, whereas 85% of the same panelists stated that they would purchase the control product. Accordingly, it is clear that, from a consumer point of view, a liner having tabs with 50% ruptured areas performs as well as or better than a liner having tabs with 100% ruptured areas.

Figure 8:
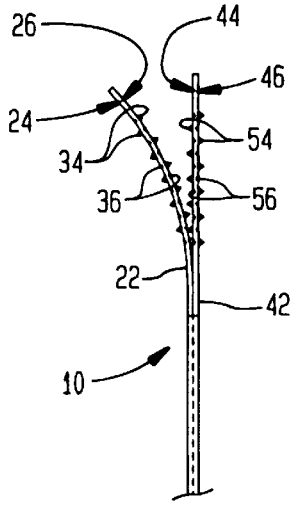
FIG. 8 is a sectional view of a second embodiment of the flexible liner of the present invention.

An alternative or second embodiment of the present invention is shown in FIG. 8. For this embodiment, the protuberances 34, 54 alternately project from the first surfaces 24, 44 and the second surfaces 26, 46 so that both surfaces of the tabs 22, 42 are textured and provide a tactile feel. Similarly, the depressions 36, 56 are positioned alternately between the protuberances 34, 54.

The tabs 22, 42 of the liner 10 may be pierced from both sides in order to form the dual textured surfaces of this second embodiment. The profile of the piercing edge would be similar to the profile of piercing edge 91 shown in FIG. 6. The difference would be that one piercing edge 91 would be situated above the tab surface and would pierce downward toward the tab surface, while a second piercing edge (not shown) would be situated below and pierce upward in order to produce the dual-sided tactile feel. This second embodiment is believed to be not as desirable since it will be more difficult to separate the pair of tabs 22, 42 prior to use.

Figure 9:
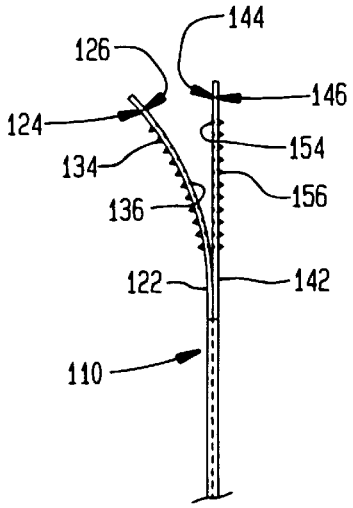
FIG. 9 is a sectional view of a third embodiment of the flexible liner of the present invention.

Referring to FIG. 9, there is shown yet another or third preferred embodiment of a flexible liner 110 of the present invention. Each tab 122, 142 has a textured surface 124, 146 and a non-textured surface 126, 144. However, in this third embodiment, the non-textured surfaces 126, 144 are positioned adjacent to each other when the liner 110 is in its collapsed or flattened form. In particular, the depressions 136 of one tab 122 are correspondingly positioned adjacent to the depressions 154 on the other tab 142.

FIG. 9, in particular, shows that tabs 122, 142 have a plurality of protuberances 134, 156 on their outer textured surfaces 124, 146 and plurality of penetrated depressions 136, 154 on their inner non-textured surfaces 26, 46. In contrast to the preferred embodiment, the separation of the tabs 122, 142 is facilitated, and essentially effortless, for this third embodiment since non-textured surfaces 126, 144 are not attached. In addition, both textured surfaces 124, 146 of the tabs 122, 142 are accessible for gripping when separating the tabs.

Also in contrast to the preferred embodiment, the tabs 122, 142 provide a consistent and balanced grip for mounting the liner 110 to a rim 62 of a rigid holder 60. As described above for the mounting operation, one tab 122 is grasped between a thumb and finger of one hand while the other tab 142 is, likewise, grasped by the other hand. For the preferred embodiment, the textured surfaces 24, 44 are grasped by the finger of one hand and the thumb of the other hand. Thus, the grips of the two hands are inconsistent, unbalanced and perhaps even awkward. The third embodiment provides a consistent and balanced grip by permitting a finger of both hands to grasp the textured surfaces 124, 146 and the thumbs to grasp the non-textured surfaces 126, 144.

However, even with its advantages, this third embodiment is believed to be not as desirable as the preferred embodiment due to the necessity and inconvenience of piercing each tab 122, 142 from the inner portion of the liner 110.

Figure 10:
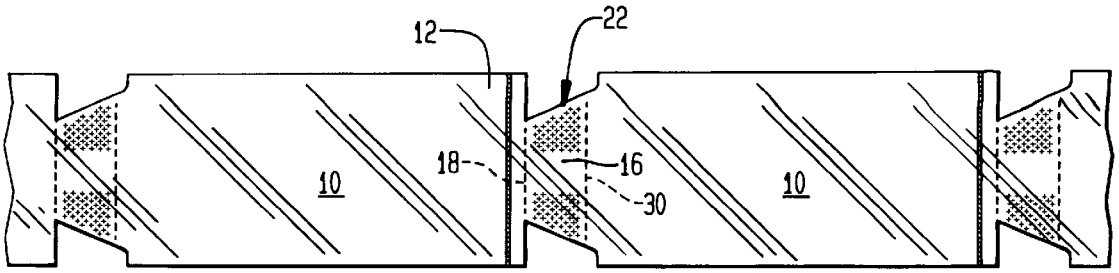
FIG. 10 is a planar view of a plurality of liners of FIG. 1.

Referring to FIG. 10, there is shown a plurality of liners 10 of the present invention that have been manufactured. The liners 10 form a continuous strip. The liners 10 are connected such that the top end 16 of one liner is continuous with the bottom end 12 of another liner. The liners 10 are transversely perforated at predetermined intervals at liner perforations 18 to facilitate the detachment of individual liners from the strip. Also, tab perforations 30 are formed across the width of the liners 10 at positions that separate the tabs 22 from the liners to facilitate the detachment of individual tabs.

The material for the liner 10 may be any type of thin sheet or film of elastomeric material, such as polyolefin resins and blends, suitable for the features described herein and may be pierced by the cutting tool. The group of polyolefin resins and blends includes Low Density Polyethylene (LDPE), Linear Low Density Polyethylene (LLDPE), Medium Density Polyethylene (MDPE), High Density Polyethylene (HDPE), Polypropylene (PP) and Ethylene-Vinyl Acetate (EVA) or other rubber or plastic materials that provide suitable strength in thin walled liner form. The preferred material is a polyethylene resin.

The invention having been thus described with particular reference to the preferred forms thereof, it will be obvious that various changes and modifications may be made therein without departing from the spirit and scope of the invention as defined in the appended claims.

Wherefore, we claim:

1. A method for forming a tactile surface on a pair of tabs of a formed flexible liner, wherein said pair of tabs includes a first tab and a second tab, said first tab having a first side and a second side wherein said second side is opposite said first side, said second tab having a third side and a fourth side wherein said fourth side is opposite said third side, said method comprising the steps of:

positioning a first tool so that a plurality of teeth of said first tool is directed toward a receiving surface of a second tool;

situating the tabs of the flexible liner between said plurality of teeth and said receiving surface;

moving at least one or both of said first tool and said second tool towards the other tool;

piercing a particular percentage of said plurality of teeth through the pair of tabs from said first side through said second side, said third side, and said fourth side of the pair of tabs, with sufficient force so that said teeth just contacts said receiving surface, thereby forming a plurality of pierced holes through the pair of tabs; and drawing said plurality of teeth away from said receiving surface, leaving a tactile surface on said second side and said fourth side of each pair of tabs and a non-tactile surface on said first side and said third side of each pair of tabs.

2. The method of claim 1 wherein said particular percentage is about 50% of said plurality of teeth.

3. The method of claim 1, wherein said tactile surface includes a plurality of ruptured protuberances and a plurality of non-ruptured protuberances.

4. The method of claim 3, wherein said plurality of ruptured protuberances are formed by said particular percentage of plurality of teeth which pierce through said pair of tabs.

5. The method of claim 3, wherein said plurality of non-ruptured protuberances are formed by a percentage of said plurality of teeth which do not pierce through said pair of tabs.

6. The method of claim 1, wherein said tactile surface is formed on an outer portion of said second side of said first tab and an outer portion of said fourth side of said second tab.

7. A method for forming a textured surface on a tab of a formed flexible liner, wherein said tab has a first side and a second side, said second side being opposite said first side, said method comprising the steps of:

disposing said tab between a first tool and a second tool, wherein said first tool has a plurality of teeth and said second tool has a receiving surface;

pressing said first tool and said second tool together so as to form a sandwich with said tab positioned therein, whereby said first side of said tab engages said plurality of teeth and said second side of said tab engages said second tool;

piercing a particular percentage of said plurality of teeth through said tab from said first side through said second side, with sufficient force so that said plurality of teeth form a plurality of ruptures through said tab; and separating said first tool and said second tool, thereby forming a textured surface on said second side of said tab.

8. The method of claim 7, wherein said textured surface includes a plurality of ruptured protuberances and a plurality of non-ruptured protuberances.

9. The method of claim 8, wherein said plurality of teeth includes a plurality of dull teeth and a plurality of piercing teeth, whereby said dull teeth form said non-ruptured protuberances and said plurality of piercing teeth form said ruptured protuberances of said textured surface.

10. The method of claim 9, wherein said plurality of piercing teeth comprises at least 50% of said teeth of said first tool, whereby at least 50% of said textured surface includes said ruptured protuberances.

11. The method of claim 7, wherein two tabs are disposed between said first tool and said second tool, thereby forming a textured surface on one side of each tab.

12. The method of claim 7, wherein said textured surface is formed on an outer portion of said tab.

13. The method of claim 7, wherein said textured surface includes a first textured area and a second textured area.

14. The method of claim 13, wherein said first textured area and said second textured area are substantially similar.

15. The method of claim 13, wherein said first textured area is spaced apart from said second textured area by a smooth surface located in-between and adjacent to said first textured area and said second textured area.

16. The method of claim 7, wherein said plurality of teeth are located on said first tool at intervals of from about 0.015 inches to 0.250 inches.

* * * * *